US007083557B2

(12) United States Patent
Phipps

(10) Patent No.: US 7,083,557 B2
(45) Date of Patent: Aug. 1, 2006

(54) STRETCHING DEVICE

(75) Inventor: Paul Phipps, Fishers, IN (US)

(73) Assignee: Innovative Biomechanical Solutions, L.L.C., Indianapolis, IN (US)

( * ) Notice: Subject to any disclaimer, the term of this patent is extended or adjusted under 35 U.S.C. 154(b) by 0 days.

(21) Appl. No.: 10/737,470

(22) Filed: Dec. 16, 2003

(65) Prior Publication Data

US 2005/0130805 A1 Jun. 16, 2005

(51) Int. Cl.
*A63B 26/00* (2006.01)
*A63B 71/00* (2006.01)

(52) U.S. Cl. ..... 482/140; 482/907; 297/5

(58) Field of Classification Search ..... 482/140, 482/907, 23, 141, 34–38, 68, 51; 297/452.65, 297/565, 440.22; 485/92, 139, 131–132; 434/247; D6/380; 4/559–612
See application file for complete search history.

(56) References Cited

U.S. PATENT DOCUMENTS

| | | | | |
|---|---|---|---|---|
| 197,076 | A * | 11/1877 | Johnson | 137/625.25 |
| 591,063 | A | 10/1897 | Spills | |
| 1,116,229 | A | 11/1914 | Boone | |
| 2,469,301 | A | 5/1949 | Johnston | |
| D197,076 | S | 10/1963 | Spackman, Jr. et al. | |
| 3,118,668 | A | 1/1964 | Callahan | |
| 3,218,065 | A | 11/1965 | Anderson | |
| 3,430,954 | A | 3/1969 | Massey | |
| 3,540,724 | A | 11/1970 | Hunter | |
| 3,601,397 | A * | 8/1971 | Carlin et al. | 482/36 |
| 3,752,472 | A * | 8/1973 | Snead | 482/35 |
| 3,966,200 | A * | 6/1976 | Kirk | 482/23 |
| 4,611,806 | A | 9/1986 | Terry | |
| 4,850,589 | A * | 7/1989 | Block | 482/36 |
| 4,957,292 | A * | 9/1990 | Ushiyama | 273/159 |
| 5,194,048 | A * | 3/1993 | Briggs | 472/128 |
| 5,356,362 | A | 10/1994 | Becker et al. | |
| D359,089 | S | 6/1995 | Taylor | |
| D368,747 | S | 4/1996 | Gifford | |
| 5,518,485 | A | 5/1996 | Zislis | |
| 5,823,925 | A | 10/1998 | Webster et al. | |
| 5,842,960 | A | 12/1998 | Yu | |
| 5,938,576 | A | 8/1999 | Minor | |
| 6,048,294 | A | 4/2000 | Formanek | |
| 6,203,473 | B1 | 3/2001 | Atwood | |
| 6,206,812 | B1 | 3/2001 | Nizamuddin | |
| 6,228,005 | B1 | 5/2001 | Gray | |
| 6,413,198 | B1 | 7/2002 | Gray | |
| 6,428,496 | B1 | 8/2002 | Sargent | |
| 6,440,045 | B1 * | 8/2002 | Gaston | 482/140 |

(Continued)

*Primary Examiner*—Lori Amerson
(74) *Attorney, Agent, or Firm*—Woodard, Emhardt, Moriarty, McNett & Henry LLP

(57) ABSTRACT

A device to facilitate stretching before engaging in athletic activities, particularly golf, is disclosed. Two inverted U-shaped members are permanently affixed to the ground using mounting plates or any other potential means. One of the U-shaped members runs underneath the other in a transverse direction generally along the center of each member. The top surfaces of the U-shaped members are designed to provide three differing levels of height thereby allowing a variety of stretches to be performed by the user. An informational sign depicting a variety of stretches may be included. One or multiple users may use this device to help facilitate a variety of stretches to improve flexibility.

16 Claims, 5 Drawing Sheets

U.S. PATENT DOCUMENTS

| | | | |
|---|---|---|---|
| 6,468,192 | B1 | 10/2002 | Doerscheln |
| 2002/0082145 | A1 | 6/2002 | Hamilton |
| 2002/0098960 | A1 | 7/2002 | Rusinak-Connors |
| 2002/0147085 | A1 | 10/2002 | Ogle |
| 2003/0040409 | A1 | 2/2003 | Lindqvist |
| 2003/0073551 | A1 | 4/2003 | Gallagher |
| 2003/0078146 | A1 | 4/2003 | Wildeman et al. |
| 2003/0199370 | A1* | 10/2003 | Bucay-Bissu |
| 2004/0198572 | A1* | 10/2004 | Rouillard |
| 2004/0224823 | A1* | 11/2004 | Myers et al. |

* cited by examiner

STRETCHING DEVICE

TECHNICAL FIELD

The invention relates to stretching, and more particularly to a device and method to facilitate stretching before engaging in athletic activities such as, for example, golf

BACKGROUND OF INVENTION

Sports are enjoyed by millions of people worldwide. Failure to stretch the leg, hip, and lower back muscles before playing sports, such as playing a round of golf, can lead to decrease in performance while playing a round. Muscle strain and injury may be an even greater danger caused by failing to stretch the muscles before playing.

Stretching devices have been well known in the art for many years. Many devices are intended to be taken and used at home or to be portable. In addition, many devices are intended to facilitate only one type of stretch instead of a number of different stretches. Most existing stretching devices are more suited for a younger athletic user, whereas many golfers may be elderly, or unfit or even handicapped. The stretching devices are usually intended to only be used by one user at a time. Moreover, even if a golfer remembers to stretch, few understand the proper stretching exercises to be performed before a round a golf. Therefore, a need exists for a stretching device that is easily accessible at a golf course, allowing one or more users with varying levels of athletic skill to understand the types of stretches necessary before playing a round of golf, and facilitating easy performance of those stretches.

The present invention fulfills this need. The invention may allow more than one user to use the device at the same time. The invention also may allow persons of varying athletic skill to use the device because a handrail is provided to assist the user in a proper stretch. An informational sign may also be included describing the proper stretches to be performed. The invention may be permanently installed at the golf course thereby providing easy access for all golfers.

SUMMARY OF INVENTION

The invention is set forth in the claims and only the claims. The following summary does not limit or define or add limitations to the claims.

A device may be used to facilitate stretching before engaging in athletic activities. The device may have two inverted U-shaped members affixed to the ground at the ends of each member. One U-shaped member may be affixed to the ground at its ends in a generally transverse orientation to the other U-shaped member. One U-shaped member may be between about 44 to 30 inches in height from the ground and between about 1 to 6 inches in width. An instructional sign may also be included with stretching instructions thereon. The device facilitates stretching.

DETAILED DESCRIPTION OF THE PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Figure 1:
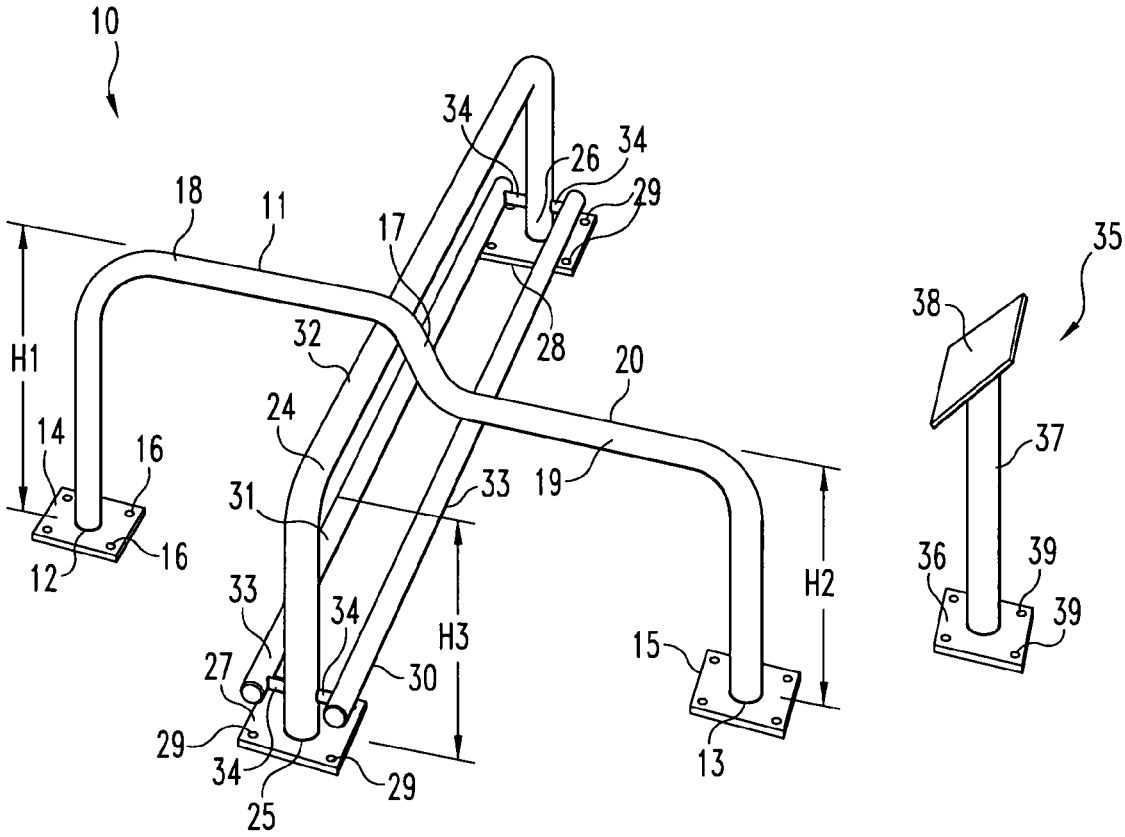
FIG. 1 is perspective view of merely one embodiment of the stretch device according to the present invention.

In FIG. 1, the present invention is shown in one embodiment as a stretching device 10 with a first U-shaped member 11 and a second U-shaped member 24. First U-shaped member 11 has a first end 12 and a second end 13 and a first mounting plate 14 and a second mounting plate 15. Mounting plates 14 and 15 are designed to affix the first end 12 and second end 13 to the ground by the use of any appropriate fastener through clearance holes 16. It is also envisioned that the first end 12 and the second end 13 can be affixed to the ground in any other manageable way to provide sturdy and solid affixation. The first U-shaped member is further made of a first horizontal section 18 and a second horizontal section 19 and a top surface 20. First U-shaped member has a sloped section 17 sloping downwardly between first horizontal section 18 and second horizontal section 19.

This arrangement places first horizontal section 18 at a greater height than the second horizontal section 19. This is illustrated in FIG. 1 as H1 and H2. Second U-shaped member 24 is placed under the first U-shaped member 11 along the center of both U-shaped members 11 and 24 and positioned generally perpendicular to each other. Any transverse orientation, however, is envisioned at any angle (45°, 90° or otherwise). Second U-shaped member 24 has a first end 25 and a second end 26. It also has a first mounting plate 27 and a second mounting plate 28. Clearance holes 29 are used with any appropriate fastener to firmly affix second U-shaped member 24 to the ground. It is envisioned, however, that any other suitable means of affixation for second U-shaped member can be provided to permanently affix second U-shaped member to the ground. Second U-shaped member 24 also includes a first elongated member 30 and second elongated member 31. First elongated member 30 and second elongated member 31 are integrated into second U-shaped member 24 via connection poles 34. Elongated members 30 and 31 may be affixed to the connection poles 34 through any reasonable means such as welding, brazing, using fasteners, or any other means known to one skilled in the art that would provide permanent and affixed attachment.

Second U-shaped member 24 has a top surface 32 and first elongated member 30 and second elongated member 31 have top surfaces 33. The cross sections of first U-shaped member 11, second U-shaped member 24, and elongated members 30 and 31 may be, but are not limited to, rounded, rectangular, hexagonal, irregular or any combination thereof. In addition, the members may have non-slip surfaces on the top of each member, completely around each member, or any mixture or combination thereof.

As depicted in FIG. 1, top surface 32 is usually of a height that allows it to fit underneath first U-shaped member 11, although they may intersect. Height of top surface 32 is shown in FIG. 1 to be designated as H3. H3 must be less than H2 in order to properly fit underneath first U-shaped member 11. Moreover, first end 12 and second end 13 and first end 25 and second end 26 may be affixed to mounting plates through using welding, brazing or any other means of attachment providing permanent attachment. This configuration allows top surface 20, top surface 32, and top surface 33 to be positioned at three differing levels of height from the ground. Top surface 20 may be between about 44 to 30 inches in height from the ground, preferably between about 42 to 34 inches from the ground, and most preferably between 41 to 35.75 inches from the ground. However, other greater or lesser heights are possible. Top surface 32 may be between about 26 to 16 inches from the ground, preferably between about 18 to 24 inches from the ground, and most preferably between about 19 to 23 inches from the ground. Finally, top surface 33 may be between about 2 to 8 inches from the ground, preferably between about 2 to 6 inches from the ground, and most preferably between about 2 to 3½ inches from the ground.

In addition, stretching apparatus 10 may include an informational sign 35. Informational sign has a mounting plate 36, a pole 37 and a sign plate 38 affixed to pole 37. Pole 37 may be affixed to mounting plate 36 by any reasonable means such as welding, brazing or any other method providing permanent affixation. Sign 35 is affixed to the ground by passing any type of fastener through clearance holes 39 to permanently affix sign 35 to the ground. Instructions on the types of stretches to be performed using stretching apparatus 10, may be inscribed upon sign plate 38 in any fashion. The sign may include the logo or trademark of a sponsor or organization. Informational sign 35 is depicted in FIG. 1 as positioned to the right of first U-shaped member 11. Any reasonable location providing easy viewing by the user is envisioned.

Figure 2:
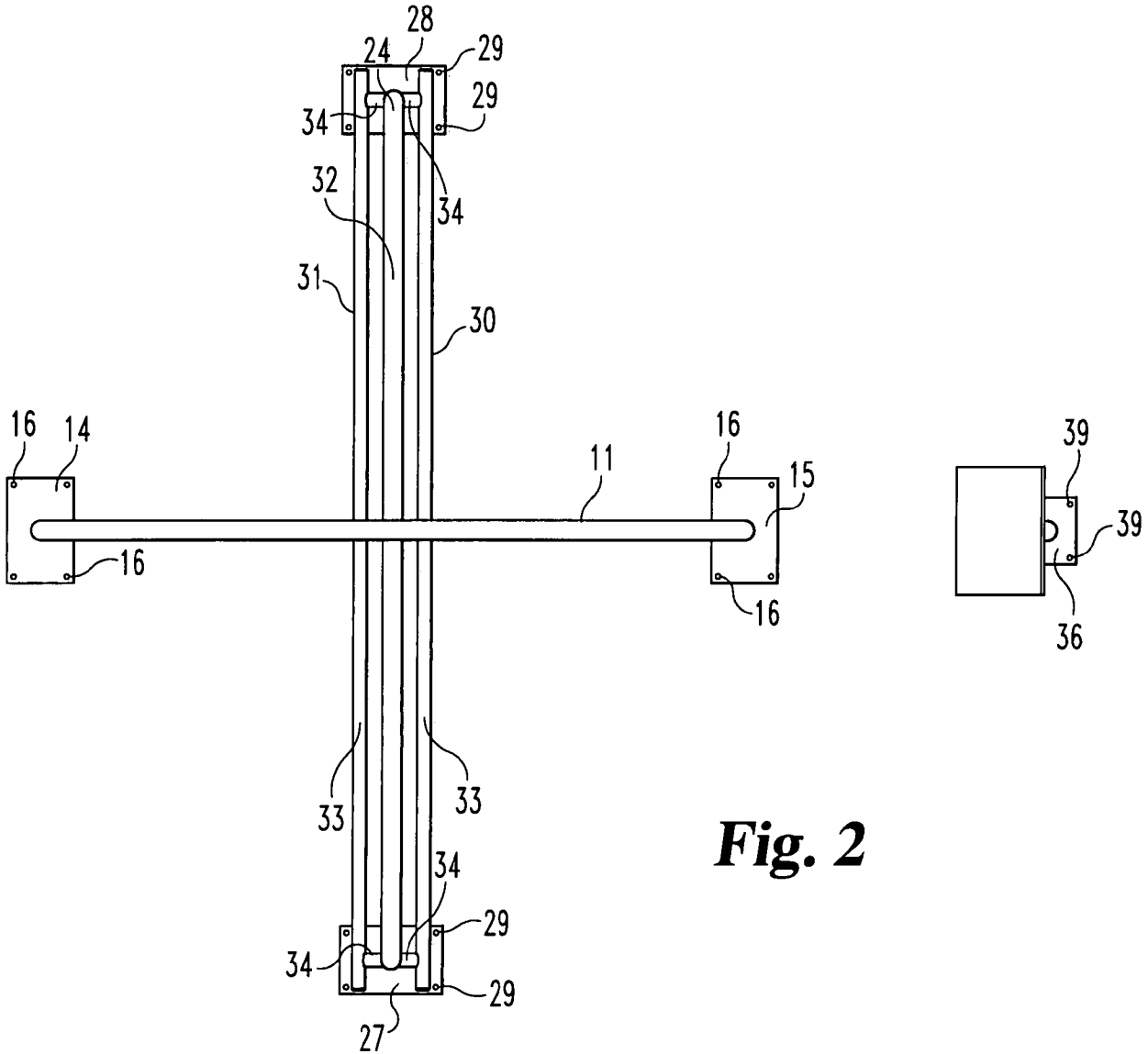
FIG. 2 is a top plan view of the embodiment of FIG. 1 showing the orientation between the U-shaped members and the instructional sign.

Referring now to FIG. 2, the device as depicted in FIG. 1 is shown from a top plan view. As FIG. 2 clearly describes, the orientation between first U-shaped member 11 and second U-shaped member 24 is transverse. This positioning allows one U-shaped member to be used as handrail while performing stretches on the second U-shaped member.

Figure 3:
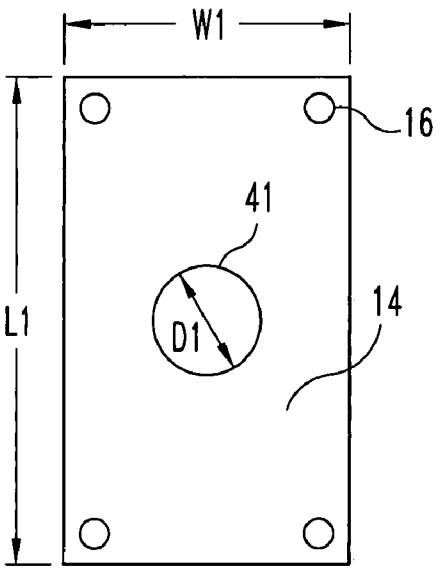
FIG. 3 is an exploded view of the mounting plates used to affix the first U-shaped member to the ground, according to one embodiment of the present invention.

Referring now to FIG. 3, an exploded view of the mounting plates used to affix the first U-shaped member 11 to the ground are shown. First mounting plate 14 has a length described as L1 and a width as W1. In addition, first mounting plate 14 has a clearance hole 41 for U-shaped member 11. The diameter of the clearance hole is depicted as D1 in FIG. 3.

Figure 4:
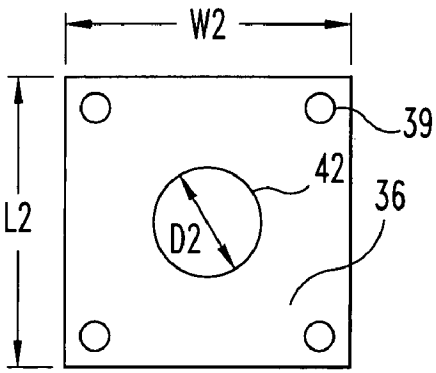
FIG. 4 is an exploded view of the mounting plate used to affix the pole and the informational sign to the ground, according to one embodiment of the present invention.

Referring now to FIG. 4, the mounting plate 36 for the pole member 37 to hold the instructional sign 35 is shown. The length of mounting plate 36 is shown as L2 and the width is shown as W2. In addition, a clearance hole 42 for pole 37 is shown. The diameter of clearance hole 42 is depicted as D2.

Figure 5:
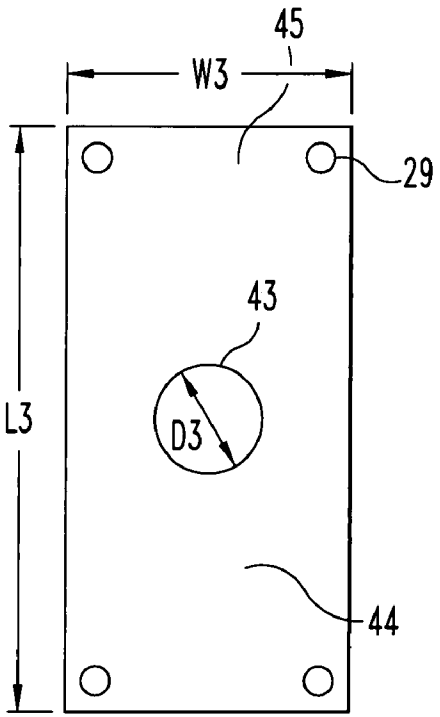
FIG. 5 is an exploded view of the mounting plates used to affix the second U-shaped member to the ground, according to one embodiment of the present invention.
Figure 7:
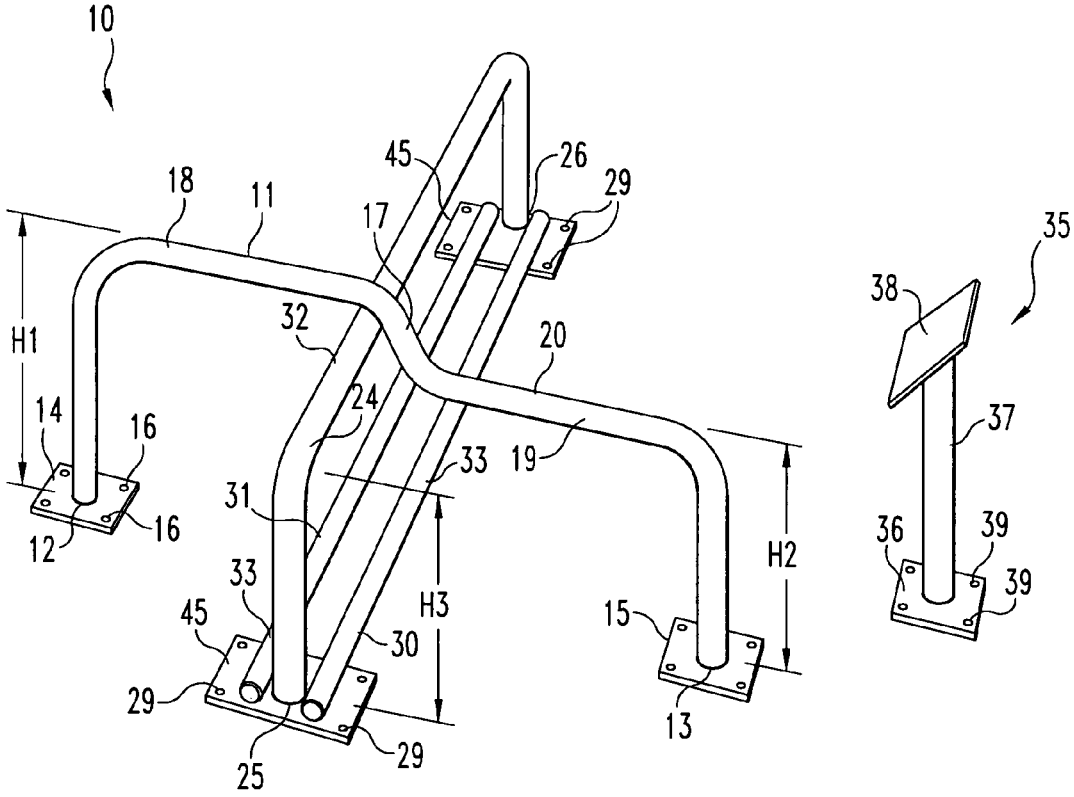
FIG. 7 is a perspective view of a third embodiment of the stretch device according to the present invention.

Referring now to FIG. 5, an exploded view of an alternative mounting plate 45 to be used to affix the second U-shaped member 24 to the ground is disclosed. As seen from FIG. 5, the length of the alternative mounting plate 45 is depicted as L3 and the width of the alternative mounting plate 45 is depicted as W3. Alternative mounting plate 45 includes a clearance hole 43 with a diameter depicted as D3. Alternative mounting plate 45 also includes a fixation area 44 providing space to affix an elongated member 30 or 31. This alternate embodiment is depicted in FIG. 7. As shown in FIG. 5, the respective lengths of the alternative mounting plates 45 are longer than mounting plates 27 or 28. Generally, L3 is greater than L1 is greater than L2. However, all of the mounting plates may have approximately the same width, although this is not critical. Thus, W3 is ordinarily approximately equal to W1 is approximately equally to W2. Moreover, the diameters of all of the clearance holes 41, 42, and 43 are preferably sized to correspondingly hold U-shaped members 11 and 24 and pole 37 and are all approximately equal. Thus, D1 may be approximately equal to D2, which may be approximately equal to D3. It is envisioned, however, that any combination of sizes for the mounting plates and clearance holes may be used.

Figure 6:
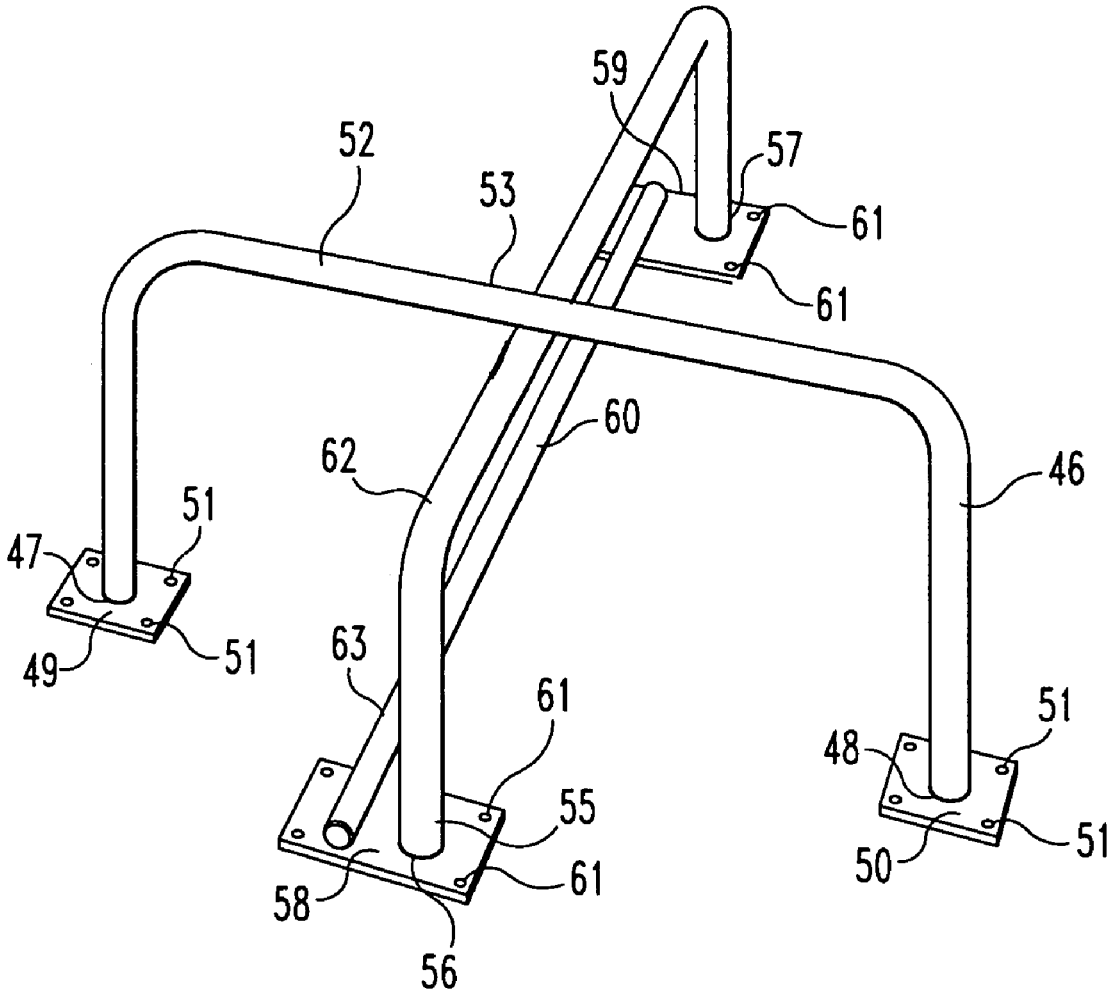
FIG. 6 is a perspective view of a second embodiment of the stretch device according to the present invention.

Referring now to FIG. 6, a second embodiment of the invention is shown. First U-shaped member 46 has a first end 47 and a second end 48. It also has a first mounting plate 49 and a second mounting plate 50. Both mounting plates include clearance holes 51. First U-shaped member has a horizontal section 52 having a top surface 53. As is readily apparent from FIG. 6, the length of the horizontal section of U-shaped member 46 may be substantially shorter than the length of the corresponding horizontal section depicted in FIG. 1. In addition, the first U-shaped member 46 may differ from the U-shaped member 11 depicted in FIG. 1 in the fact that there is ordinarily no downwardly sloping section along the middle. The second U-shaped member 55 runs transverse to first U-shaped member 46 generally along the middle of both first U-shaped member 46 and second U-shaped member 55, although it could also run at any non-perpendicular angle, if so desired. The height of second U-shaped member 55 may be less than the height of first U-shaped member 46 to allow clearance between the respective members.

Second U-shaped member 55 has a first end 56 and a second end 57. These ends are affixed to first mounting plate 58 and second mounting plate 59. The affixation may be made of any reasonable means such as welding, brazing or any other method of permanent affixation. While mounting plates are disclosed in order to allow the affixation of U-shaped members 46 and 55 to the ground, it is envisioned that any reasonable means to affix the members permanently to ground can be utilized. Also affixed to first mounting plate 58 and second mounting plate 59, is an elongated member 60. Mounting plates 58 and 59 may be permanently affixed to the ground by the use of a fastening means through clearance holes 61. Second U-shaped member 55 has a top surface 62. Elongated member 60 also has a top surface 63. Again, the positioning of top surface 53, top surface 62, and top surface 63 ordinarily provide at least three differing levels of height from the ground. The embodiment depicted in FIG. 6 allows a smaller more compact stretching system to be easily located in a small area on a golf course.

Referring now to FIG. 7, a third embodiment of the invention is shown. This embodiment is identical to the embodiment disclosed in FIG. 1 except for the method of attaching first elongated member 30 and second elongated member 31. The alternative mounting plates 45 disclosed in FIG. 5 provide a surface to integrate elongated member 30 and 31 into second U-shaped member 24. Elongated members 30 and 31 may be affixed to the alternative mounting plates 45 through any reasonable means such as welding, brazing, using fasteners, or any other means known to one skilled in the art that would provide permanent and affixed attachment.

While the invention has been illustrated and described in detail in the drawings and foregoing description, the same is to be considered as illustrative and not restrictive in character, it being understood that only the preferred embodiment have been shown and described and that all changes and modifications that come within the spirit of the invention are desired to be protected. The articles "a", "an", "said" and "the" are not limited to a singular element, and include one or more such element.

What is claimed is:

1. A device to facilitate stretching before engaging in athletic activities comprising:

(a) a first inverted U-shaped member having a first end and a second end and a horizontal section therebetween, wherein said first U-shaped member is a handrail between about 44 to 30 inches in height from the ground, and between about 1 to 6 inches in width and is sturdy to support a muscle-stretching user thereon, wherein said first U-shaped member is supported on a horizontal surface, such as the ground;

(b) a second inverted U-shaped member having a first end and a second end and a horizontal section therebetween, wherein said second U-shaped member is between about 26 to 16 inches in height from the ground, and between about 1 to 6 inches in width and is sturdy to support a muscle-stretching user thereon, wherein said second U-shaped member runs underneath said first U-shaped member in a generally transverse orientation to said first U-shaped member, wherein said second U-shaped member is supported on a horizontal surface, such as the ground, and wherein said transverse handrail facilitates muscle stretching on said second member.

2. A device as described in claim 1 wherein said second U-shaped member further comprises:

(a) a first mounting plate affixed to said first end of said, second U-shaped member, (b) a second mounting plate affixed to said second end of said second U-shaped member; and (c) two elongated members affixed to said second U-shaped member via connection poles and running parallel to said second U-shaped member.

3. The device as described in claim 2 further comprising a first top surface of said first U-shaped member and a second top surface of second U-shaped member, wherein said top surfaces of said U-shaped members are constructed and arranged to collectively provide at least three horizontal sections at varying levels of height from the ground.

4. The device as described in claim 3 wherein said U-shaped members have a cross-section that is rounded.

5. The device as described in claim 4 wherein said elongated members have an adhesive non-slip surface on the top of said elongated members.

6. A device to facilitate stretching before engaging in athletic activities comprising:

(a) a first inverted U-shaped member having a first end and a second end and a horizontal section therebetween, wherein said first U-shaped member is affixed to the ground at said ends, wherein said first U-shaped member is between about 44 to 30 inches in height from the ground, and between about 1 to 6 inches in width;

(b) a second inverted U-shaped member having a first end and a second end and a horizontal section therebetween, said second inverted U-shaped member comprising:

1. a first mounting plate affixed to said first end of said second U-shaped member, 2. a second mounting plate affixed to said second end of said second U-shaped member; and 3. two elongated members affixed to said second U-shaped member via connection poles and running parallel to said second U-shaped member;

said device further comprising a first top surface of said first U-shaped member and a second top surface of second U-shaped member, wherein said top surfaces of said U-shaped members are constructed and arranged to collectively provide at least three horizontal sections at varying levels of height from the ground, wherein said second U-shaped member is affixed to the ground at said ends; wherein said second U-shaped member is between about 26 to 16 inches in height from the ground, and between about 1 to 6 inches in width; wherein said second U-shaped member is affixed to the ground running underneath said first U-shaped member in a generally transverse orientation to said first U-shaped member, wherein said U-shaped members have a cross section that is rounded, wherein said elongated members have an adhesive non-slip surface covering at least a portion of said elongated members.

7. A device to facilitate stretching before engaging in athletic activities comprising:

(a) a first inverted U-shaped member having a first end and a second end and a horizontal section therebetween, wherein said first U-shaped member is affixed to the ground at said ends, wherein said first U-shaped member is between about 44 to 30 inches in height from the ground, and between about 1 to 6 inches in width;

(b) a second inverted U-shaped member having a first end and a second end and a horizontal section therebetween, said second inverted U-shaped member comprising:

1. a first mounting plate affixed to said first end of said second U-shaped member, 2. a second mounting plate affixed to said second end of said second U-shaped member; and 3. two elongated members affixed to said second U-shaped member via connection poles and running parallel to said second U-shaped member;

said device further comprising a first top surface of said first U-shaped member and a second top surface of second U-shaped member, wherein said top surfaces of said U-shaped members are constructed and arranged to collectively provide at least three horizontal sections at varying levels of height from the ground, wherein said second U-shaped member is affixed to the ground at said ends; wherein said second U-shaped member is between about 26 to 16 inches in height from the ground, and between about 1 to 6 inches in width; wherein said second U-shaped member is affixed to the ground running underneath said first U-shaped member in a generally transverse orientation to said first U-shaped member, wherein said U-shaped members have a cross section that is rounded, wherein said U-shaped members have an adhesive non-slip surface coving at least a portion of said U-shaped members.

8. The device as described in claim 1 further comprising an informational sign, wherein said informational sign has stretching instructions inscribed thereon.

9. The device as described in claim 1 wherein said U-shaped members have a cross section that is rounded.

10. The device as described in claim 1 further comprising a first top surface of said first U-shaped member and a second top surface of second U-shaped member, wherein said top surfaces of said U-shaped members are constructed and arranged to provide at least three horizontal sections at varying levels of height from the ground.

11. A device to facilitate stretching before engaging in athletic activities consisting essentially of:

(a) a first elongated member positioned in a horizontal orientation about 44 to 30 inches in height from the ground; and (b) a second elongated member positioned in a horizontal orientation about 26 to 16 inches in height from the ground;

wherein said elongated members are study to support a muscle-stretching user thereon and said first elongated member is a handrail constructed and arranged transverse to said second elongated member, and wherein said transverse handrail facilitates muscle stretching on said second elongated member.

12. The device as described in claim 1 wherein said first and second U-shaped members form a generally X-shaped configuration from a top plan view, creating at least four muscle-stretching areas.

13. The device as described in claim 1 wherein said handrail includes at least two heights.

14. The device as described in claim 11 wherein said handrail includes at least two heights.

15. The device as described in claim 11 wherein said second elongated member runs underneath said first elongated member.

16. The device as described in claim 11 wherein said first and second elongated members form a generally X-shaped configuration from a top plan view, creating at least four muscle-stretching areas.

* * * * *

UNITED STATES PATENT AND TRADEMARK OFFICE

CERTIFICATE OF CORRECTION

PATENT NO. : 7,083,557 B2
APPLICATION NO. : 10/737470
DATED : August 1, 2006
INVENTOR(S) : Paul B. Phipps It is certified that error appears in the above-identified patent and that said Letters Patent is hereby corrected as shown below:

Column 1, line 7, please add --.-- after the word "golf"

Column 5, line 37, please remove "," after "said"

Column 7, line 17, please change "study" to --sturdy--

Signed and Sealed this

Thirty-first Day of October, 2006

JON W. DUDAS
*Director of the United States Patent and Trademark Office*